United States Patent [19]

Namba et al.

[11] 4,038,217

[45] July 26, 1977

[54] CERAMICS HAVING NON-LINEAR VOLTAGE CHARACTERISTICS AND METHOD OF PRODUCING THE SAME

[75] Inventors: Masaharu Namba; Ikuo Nagasawa; Kazuo Mukae, all of Kawasaki, Japan

[73] Assignee: Fuji Electric Company Ltd., Kawasaki, Japan

[21] Appl. No.: 598,956

[22] Filed: July 24, 1975

[30] Foreign Application Priority Data

| | | |
|---|---|---|
| July 25, 1974 | Japan | 49-85425 |
| July 25, 1974 | Japan | 49-85426 |
| July 25, 1974 | Japan | 49-85427 |

[51] Int. Cl.[2] ..... H01C 1/06; H01B 1/08

[52] U.S. Cl. ..... 252/521; 106/73.2; 252/518; 252/519; 338/20; 338/21

[58] Field of Search ..... 252/521, 518, 519; 338/20, 21; 106/73.2

[56] References Cited

U.S. PATENT DOCUMENTS

| | | | |
|---|---|---|---|
| 3,503,029 | 3/1970 | Matsuoka | 252/518 X |
| 3,663,458 | 5/1972 | Masuyama et al. | 252/519 |
| 3,699,058 | 10/1972 | Matsuoka et al. | 252/521 |
| 3,928,242 | 12/1975 | May | 338/20 |

*Primary Examiner*—Helen M. McCarthy

*Attorney, Agent, or Firm*—Sughrue, Rothwell, Mion, Zinn and Macpeak

[57] ABSTRACT

A ceramic having non-linear voltage characteristics, comprising the product obtained on mixing (a) zinc oxide, as a principal component, and (b) (1) cobalt and (2) one of neodymium, samarium or dysprosium, either in an elemental form or as a compound thereof, each in an amount of 0.1 to 10 atomic % for the cobalt, neodymium, samarium and dysprosium, calculated as cobalt, neodymium, samarium and dysprosium as subcomponents, and calcining the mixture at a temperature of from about 1150° to about 1400° C.

9 Claims, 6 Drawing Figures

CERAMICS HAVING NON-LINEAR VOLTAGE CHARACTERISTICS AND METHOD OF PRODUCING THE SAME

BACKGROUND OF THE INVENTION

1. Field of the Invention

This invention relates to a ceramic which has non-linear voltage characteristics and is suitable for use as an overvoltage protecting resistor and to a method for producing the same.

2. Description of the Prior Art

Heretofore, over-voltage protecting resistors made of a silicon carbide varistor, a selenium varistor, and the like have been widely used practically. However, the over-voltage resistivity of a semiconductor element such as a diode, a transistor, and a thyristor is far lower than that of the ordinary electrical machine or piece of equipment. When protection of the semiconductor element from an over-voltage is desired, a resistor used for that purpose must have the characteristic of a low limiting voltage and the greatest non-linearity for voltage. In this respect, neither a silicon carbide varistor nor a selenium varistor have any significant voltage non-linearity, and furthermore, the limiting voltage of the silicon carbide varistor is high while the loading capability of the selenium varistor is low and the size thereof becomes large. These characteristics are thus the drawbacks of conventional overvoltage protecting resistors. In addition to the above-described resistors, an arrester having series gaps and an arresting tube are known. These are, however, not suitable for the protection of semiconductor elements because of their high limiting voltage.

SUMMARY OF THE INVENTION

Thus, the present invention provides a ceramic which has a high voltage non-linearity, and thus the drawbacks of conventional resistors are overcome.

The ceramic comprises the product obtained on mixing (a) zinc oxide (ZnO), as a principal component, and (b) (1)cobalt (Co) and (2) one of neodymium (Nd), samarium (Sm) or dysprosium (Dy), as subcomponents, in an elemental form or as a compound thereof, each in an amount of from 0.1 to 10 atomic % for the Co, the Nd, the Sm and the Dy and calcining the mixture.

The present invention also provides a method for producing a ceramic having non-linear voltage characteristics comprising mixing (a) zinc oxide, as a principal component, and (b) (1) cobalt and (2) one of neodymium, samarium or dysprosium, either in an elemental form or as a compound thereof, each in an amount of 0.1 to 10 atomic % for the cobalt, neodymium, samarium and dysprosium, respectively, calculated as cobalt, neodymium, samarium, and dysprosium, as subcomponents and calcining the mixture at a temperature of from about 1150° C to about 1400° C.

DETAILED DESCRIPTION OF THE INVENTION

Figure 1:
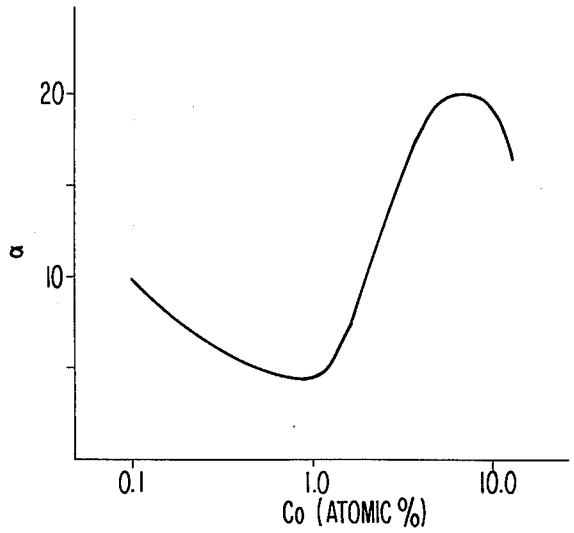
FIGS. 1 to 6 are graphical representations of the characteristics of the ceramics according to the present invention, which are varied depending on the component ratio.

The Co and one of Nd, Sm, or Dy constituting the subcomponents can be added in the form of their oxides, such as $Co_3O_4$, CoO, $Co_2O_3$, $Nd_2O_3$, $Sm_2O_3$ and $Dy_2O_3$, or other compounds not having these chemical formulae, or they can be added in the form of elemental Co, Nd, Sm and Dy, since the compounds or elements are changed during the subsequent calcining step into oxides of Co, Nd, Sm and Dy.

A current I flowing through a non-linear voltage element at the time of application of a voltage V can be approximated by the following equation.

$$I = \left(\frac{V}{C}\right)^{\alpha}$$

wherein C corresponds to the voltage per mm of the element when the current density is equal to 1 mA/cm$^2$, and $\alpha$ is the voltage non-linearity factor. It is desirable for C to be selected at a suitable value depending on the use conditions of the element, and $\alpha$ to be selected to be the largest possible value.

In the ceramics according to the present invention, if the amounts of the subcomponents added to the principal component are changed, or the calcining temperature is changed, the values of C and $\alpha$ vary. For this reason, the amounts of the subcomponents added and the calcining temperature of the resultant material preferably are adjusted so that a greatest possible value of $\alpha$ is obtained at a desired value of C.

In the ZnO series ceramic according to this invention, the advantageous effects required cannot be obtained if only one of (b) (1) Co and (b) (2), one of Nd, Sm or Dy, is employed. That is, when only Nd, Sm or Dy is employed, the $\alpha$ thus obtained is so small that the ceramic cannot be used practically, and when only Co is employed, the ceramic thus obtained exhibits very little voltage non-linearity and is substantially equivalent to an ohmic resistor. A ceramic which has excellent voltage non- linearity and which can be used practically is obtained only when Co and one of Nd, Sm or Dy are employed at the appropriate ratio and in the amounts according to this invention.

The reason why the lower limit of the Co, Nd, Sm and Dy is 0.1 atomic %, while the upper limit of the Co, Nd, Sm and Dy is 10 atomic %, is as follows. Although some differences occur due to the calcining temperature, when the amounts of Co, Nd,, Sm and Dy employed are less than 0.1 atomic %, respectively, no remarkable effects are obtained by the addition of these components, and the characteristics of the resistance element become inferior and variable. When the amounts of Co, Nd, Sm and Dy employed are more than 10 atomic %, $\alpha$ tends to decrease and the characteristics of the same element become unstable.

The calcining step is carried out, for instance, in air at a temperature of from about 1150° C to about 1400° C or preferably from 1300° C to 1350° C. When the calcining temperature is lower than about 1150° C, the density of the calcined product is reduced, the mechanical strength thereof is weakened, and the electrical characteristics thereof become inferior. In contrast, when the calcining temperature exceeds about 1400° C, the value of $\alpha$ is reduced, and when the temperature exceeds about 1500° C, production of a uniform calcined material becomes difficult, and difficulties are also experienced in reproducibility and control of the characteristics of the products.

The invention will now be described more specifically with respect to embodiments of the present invention.

EXAMPLE 1

Various ceramics were produced as follows. Nd and Co were added to ZnO in the form of the compounds, $Nd_2O_3$ and $Co_3O_4$, at various composition ratios and quantities. The mixtures thus obtained were kneaded sufficiently and were calcined at 700° C for one hour. Each of the thus obtained materials was ground sufficiently, formed into circular discs of a diameter of 16 mm, and calcined at various temperatures for one hour. The ceramics thus produced were ground until a thickness of one mm was obtained, electrodes were attached on both surfaces thereof, and the characteristics of the ceramics were measured. The characteristics thus measured of the ceramic resistors are now indicated, instead of C and $\alpha$, by a voltage $V_1$ at the time of a current therethrough of 1mA and $\alpha$, and described as follows.

Figure 2:
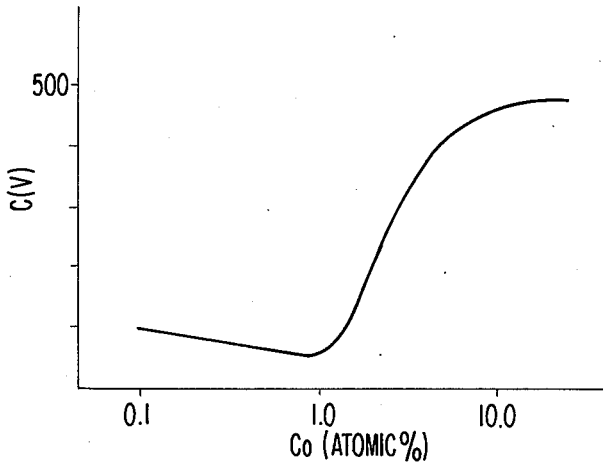

In FIG. 1, the maxium values of $\alpha$ are plotted vs. the amount of Co where the calcining temperature was 1300° C, Nd was added in the form of $Nd_2O_3$ in an amount of from 0.1 to 10 atomic %, calculated as Nd, and in FIG. 2, the corresponding values of C are similarly plotted.

From FIGS. 1 and 2, it is apparent that ceramics exhibiting superior non-linear voltage characteristics could be obtained within the range of the amounts employed according to this invention where C is approximately from 50 V to 450 V. Furthermore, it is of course possible to control C over a wider range by varying the calcining temperature from the above described value.

EXAMPLE 2

Various ceramics were produced as described in Example 1 except that $Sm_2O_3$ was used, instead of the $Nd_2O_3$, at various composition ratios and quantities. The kneading, calcining and sample preparation procedures employed in Example 1 were repeated and the characteristics of the ceramic resistors were measured and are also indicated by C and $\alpha$, as in Example 1.

Figure 3:
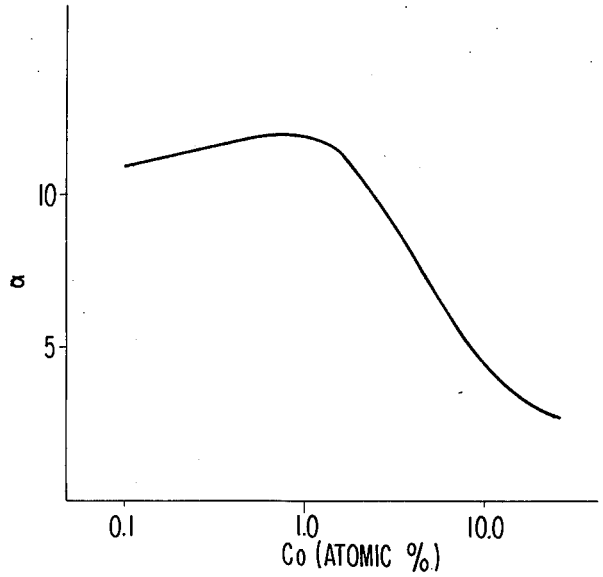
Figure 4:
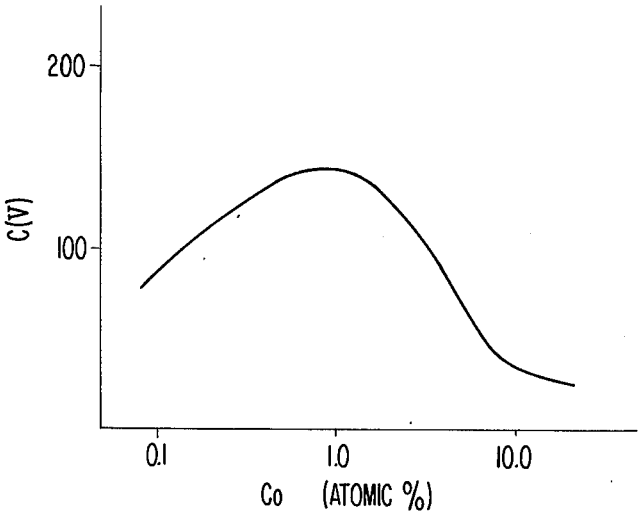

In FIG. 3, the maximum values of $\alpha$ vs. the amount of Co are plotted, where the calcining temperature was 1300° C, the Sm was added in the form of $Sm_2O_3$ in an amount of from 1.0 to 10 atomic %, calculated as Sm, and in FIG. 4 the corresponding values of C are similarly plotted.

From FIGS. 3 and 4, it is apparent that ceramics exhibiting superior non-linear voltage characteristics were obtained within the range of the amounts employed according to this invention where C is approximately from 40 V to 150 V. Furthermore, it is of course possible to control C over a wider range by varying the calcining temperature from the above described value.

EXAMPLE 3

Various ceramics were produced as described in Example 1, except that $Dy_2O_3$ was used instead of the $Nd_2O_3$, at various composition ratios and quantities. The kneading, calcining and sample preparation procedures employed in Example 1 were repeated. The characteristics of the ceramic resistor were measured and are now also indicated by C and $\alpha$ as in Example 1.

Figure 5:
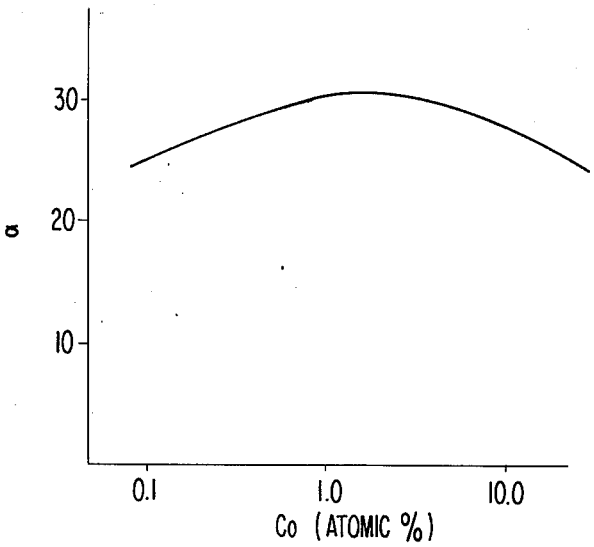
Figure 6:
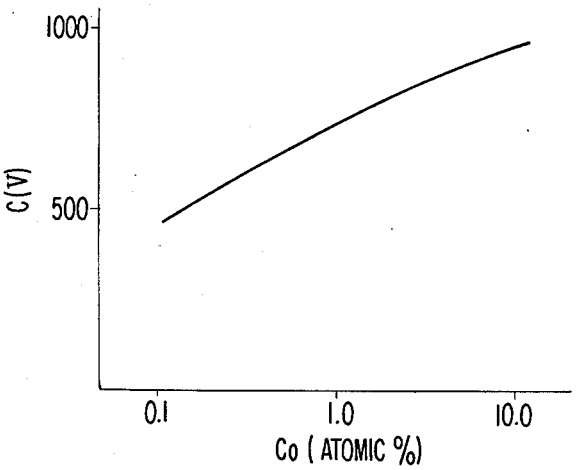

In FIG. 5, the maximum values of $\alpha$ vs. the amount of Co are plotted, where the calcining temperature was 1300° C and the Dy was added in the form of $Dy_2O_3$ in an amount of from 0.1 to 10 atomic %, calculated as Dy, and in FIG. 6 the corresponding values of C are similarly plotted.

From FIGS. 5 and 6, it is apparent that ceramics exhibiting superior non-linear voltage characteristics were obtained within the range of the amount employed according to this invention where C is approximately from 200 to 950 V. Furthermore, it is of course possible to control C over a wider range by varying the calcining temperature from the above described value.

As described above, the ceramics according to this invention can have various voltages and high voltage non- linearity factors by appropriately controlling the calcining temperature and added amounts of the subcomponents and therefore can be applied to the protection of various electronic devices rated at low voltages.

While the invention has been described in detail and with reference to specific embodiments thereof, it will be apparent to one skilled in the art various changes and modifications can be made therein without departing from the spirit and scope thereof.

What is claimed is:

1. A ceramic having non-linear voltage characteristics consisting essentially of the calcined product obtained on calcining in air a mixture of (a) zinc oxide, as a principal component, and (b) (1) cobalt and (2) one of neodymium, samarium or dysprosium, either in an elemental form or as a compound thereof, each in an amount of 0.1 to 10 atomic % for the cobalt, neodymium, samarium and dysprosium, calculated as cobalt, neodymium, samarium, and dysprosium, respectively, as subcomponents.

2. The ceramic of claim 1, wherein said ceramic consists essentially of zinc oxide, and oxides of cobalt and neodymium.

3. The ceramic of claim 1, wherein said ceramic consists essentially of zinc oxide, and oxides of cobalt and samarium.

4. The ceramic of claim 1, wherein said ceramic consists essentially of zinc oxide, and oxides of cobalt and dysprosium.

5. A method for producing a ceramic having non-linear voltage characteristics consisting essentially of mixing (a) zinc oxide, as a principal component, and (b) (1) cobalt and (2) one of neodymium, samarium or dysprosium, either in an elemental form or as a compound thereof each in an amount of 0.1 to 10 atomic % for the cobalt, neodymium, samarium and dysprosium, respectively, calculated as cobalt, neodymium, samarium, and dysprosium, as subcomponents; and calcining the mixture in air at a temperature of from about 1150° C to about 1400° C.

6. The method of preparing the ceramic of claim 5, wherein said calcining is in air at 1300° C to 1350° C.

7. The method of preparing the ceramic of claim 5, wherein said mixture consists essentially of zinc oxide and cobalt and neodymium in elemental form or as a compound thereof.

8. The method of preparing the ceramic of claim 5, wherein said mixture consists essentially of zinc oxide and cobalt and samarium in elemental form or as a compound thereof.

9. The method of preparing the ceramic of claim 5, wherein said mixture consists essentially of zinc oxide and cobalt and dysprosium in elemental form or as a compound thereof.

* * * * *